US009859633B2

(12) United States Patent
Sakai et al.

(10) Patent No.: US 9,859,633 B2
(45) Date of Patent: Jan. 2, 2018

(54) BOARD CONNECTOR

(71) Applicant: Sumitomo Wiring Systems, Ltd., Yokkaichi, Mie (JP)

(72) Inventors: Masami Sakai, Mie (JP); Yoshiyuki Ishikawa, Mie (JP)

(73) Assignee: SUMITOMO WIRING SYSTEMS, LTD., Yokkaichi, Mie (JP)

( * ) Notice: Subject to any disclaimer, the term of this patent is extended or adjusted under 35 U.S.C. 154(b) by 0 days.

(21) Appl. No.: 15/278,116

(22) Filed: Sep. 28, 2016

(65) Prior Publication Data

US 2017/0110814 A1 Apr. 20, 2017

(30) Foreign Application Priority Data

Oct. 19, 2015 (JP) ..... 2015-205523

(51) Int. Cl.
*H01R 12/70* (2011.01)
*H01R 12/71* (2011.01)
*H01R 12/73* (2011.01)

(52) U.S. Cl.
CPC ..... *H01R 12/7023* (2013.01); *H01R 12/716* (2013.01); *H01R 12/737* (2013.01)

(58) Field of Classification Search
CPC .. H01R 24/60; H01R 2107/00; H01R 12/716; H01R 12/724; H01R 12/79; H01R 13/6658; H01R 12/73; H01R 24/28; H01R 12/58; H01R 13/639; H01R 13/6581; H01R 12/7029; H01R 12/721; H01R 12/75; H01R 12/62; H01R 12/707; H01R 12/732; H01R 12/737; H01R 12/77; H01R 13/20; H01R 13/2435; H01R 13/627; H01R 13/6275; H01R 12/05
See application file for complete search history.

(56) References Cited

U.S. PATENT DOCUMENTS 4,173,387 A * 11/1979 Zell ..... H01R 12/7029 439/557
4,426,123 A * 1/1984 Ritchie ..... H01R 12/89 439/368
4,713,024 A * 12/1987 Hatakeyama ..... H01R 24/547 439/551
5,697,812 A * 12/1997 Sampson ..... H01R 12/7023 439/557
5,980,314 A * 11/1999 Roberts ..... H01R 12/7023 439/567
6,109,961 A * 8/2000 Chen ..... H01R 12/7029 439/567

(Continued)

FOREIGN PATENT DOCUMENTS

JP 8-148214 6/1996

*Primary Examiner* — Truc Nguyen
(74) *Attorney, Agent, or Firm* — Gerald E. Hespos; Michael J. Porco; Matthew T. Hespos

(57) ABSTRACT

A board connector has a housing (11) with legs (16) on a lower surface (13) facing a surface side of a circuit board (30). A locking portion (21) is provided on a tip end of the leg (16) and protrudes in a direction intersecting with a projecting direction from the lower surface (13) and can be locked to an underside of the circuit board (30). A base end of the leg portion (16) is defined by a displacement allowing space (25) recessed in from the lower surface (13) of the housing (11).

12 Claims, 7 Drawing Sheets

(56) References Cited

U.S. PATENT DOCUMENTS

| | | | | |
|---|---|---|---|---|
| 6,454,600 | B1 * | 9/2002 | Jones | H01R 12/7058 439/571 |
| 7,658,643 | B2 * | 2/2010 | Tuerschmann | H01R 12/7047 439/564 |
| 7,713,086 | B2 * | 5/2010 | Schmitz | H01R 12/585 439/567 |
| 2008/0020608 | A1 * | 1/2008 | Takahashi | H01R 12/7029 439/78 |
| 2009/0257199 | A1 * | 10/2009 | Henderson | H01G 2/06 361/728 |
| 2009/0275222 | A1 * | 11/2009 | Wang | H01R 12/7023 439/82 |

* cited by examiner

BOARD CONNECTOR

BACKGROUND

1. Field of the Invention

The invention relates to a board connector.

2. Description of the Related Art

Japanese Unexamined Patent Publication No. H08-148241 relates to a board connector with a housing. Legs are cantilevered from the lower surface of the housing, and locks project from outer peripheral surfaces of the legs. The legs are inserted into through holes formed on a circuit board. The locks contact peripheral edge parts of the through holes as the legs are inserted into the through holes and this contact causes the legs to deform. The legs restore resiliently when the locks pass through the through holes, and the locks engage the underside of the circuit board to fix the board connector to the circuit board.

Consideration has been given to making engagement margins between the locks and the circuit board larger to enhance a force for holding the circuit board. However, a larger engagement margin between the locks and the circuit board requires the legs to be deformed more when passing through the through holes and increase the required insertion force. Longer legs could be deformed more easily, but enlarge the connector.

The invention was completed based on the above situation and aims to facilitate deformation of the legs without enlarging the board connector.

SUMMARY

The invention is directed to a board connector with a housing having a bottom surface facing a surface side of a circuit board and a leg projects from the bottom surface. A lock is formed near a free end of the leg and protrudes in a direction intersecting a projecting direction of the leg from the bottom surface. The lock is to be locked to an underside of the circuit board is provided on a tip side of the leg portion. A base end of the leg has a displacement allowing space that is recessed inward from the bottom surface of the housing. The displacement allowing space ensures a sufficient resilient displacement region for the leg without enlarging the board connector.

The housing may include a tubular receptacle. The bottom surface may be configured as an outer surface of a bottom wall of the receptacle and the displacement allowing space may be a hole penetrating through the bottom wall of the receptacle. If the displacement allowing space is a bottomed recess open on the bottom surface of the bottom wall of the receptacle, only a depth of the recess can be ensured as the resilient displacement region of the base end side of the leg. In that respect, the displacement allowing space is a hole penetrating through the bottom wall of the receptacle so that a sufficient resilient displacement region of the leg can be ensured.

A pressed portion may be provided on an opening edge part of the displacement allowing space on an inner surface of the bottom wall of the receptacle and may be pressed by a mating connector fitted into the receptacle. The pressed portion is pressed by the mating connector. Thus, the leg is tilted and the locking portion can be displaced in a direction to increase a locking margin with the circuit board. Thus, a locking force of the leg to the circuit board can be enhanced.

Plural legs may be arranged via the displacement allowing space and an inserting member may be inserted into among the plurality of legs. The insertion of the inserting member among the plurality of legs restricts a resilient displacement of each leg. Thus, a locked state of the locks to the circuit board can be maintained stably.

BRIEF DESCRIPTION OF THE DRAWINGS

FIGS. 7(A) and 7(B) show a board connector in a second embodiment, wherein FIG. 7(A) is a view corresponding to the cross-section along X-X of FIG. 3 showing a state where a fixing portion is inserted in a through hole of a circuit board and FIG. 7(B) is a similar cross-section along X-X of FIG. 3 showing a state where an inserting member is inserted among legs.

DETAILED DESCRIPTION

Figure 1:
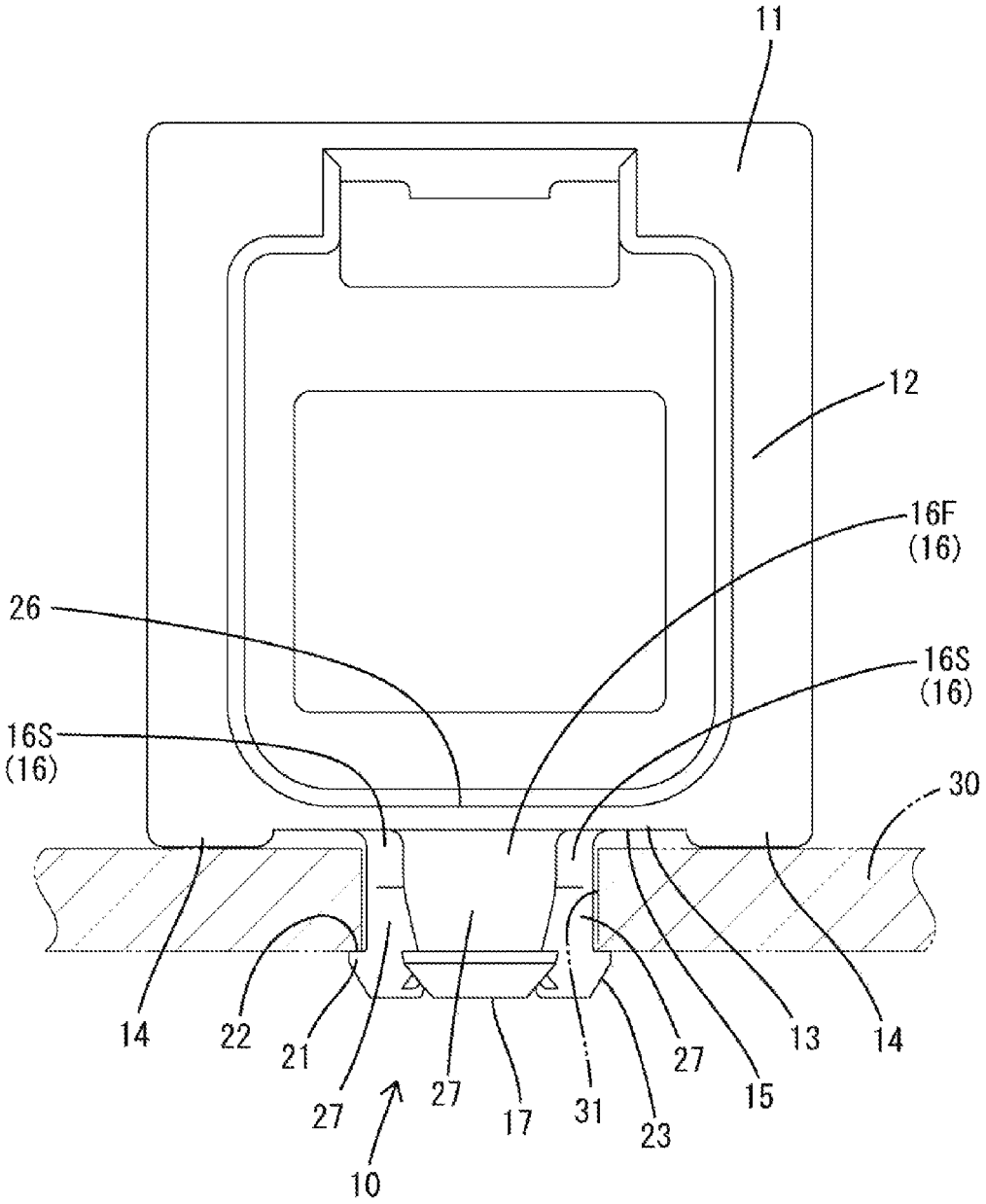
FIG. 1 is a front view showing a board connector in first embodiment in a state fixed to a circuit board.
Figure 2:
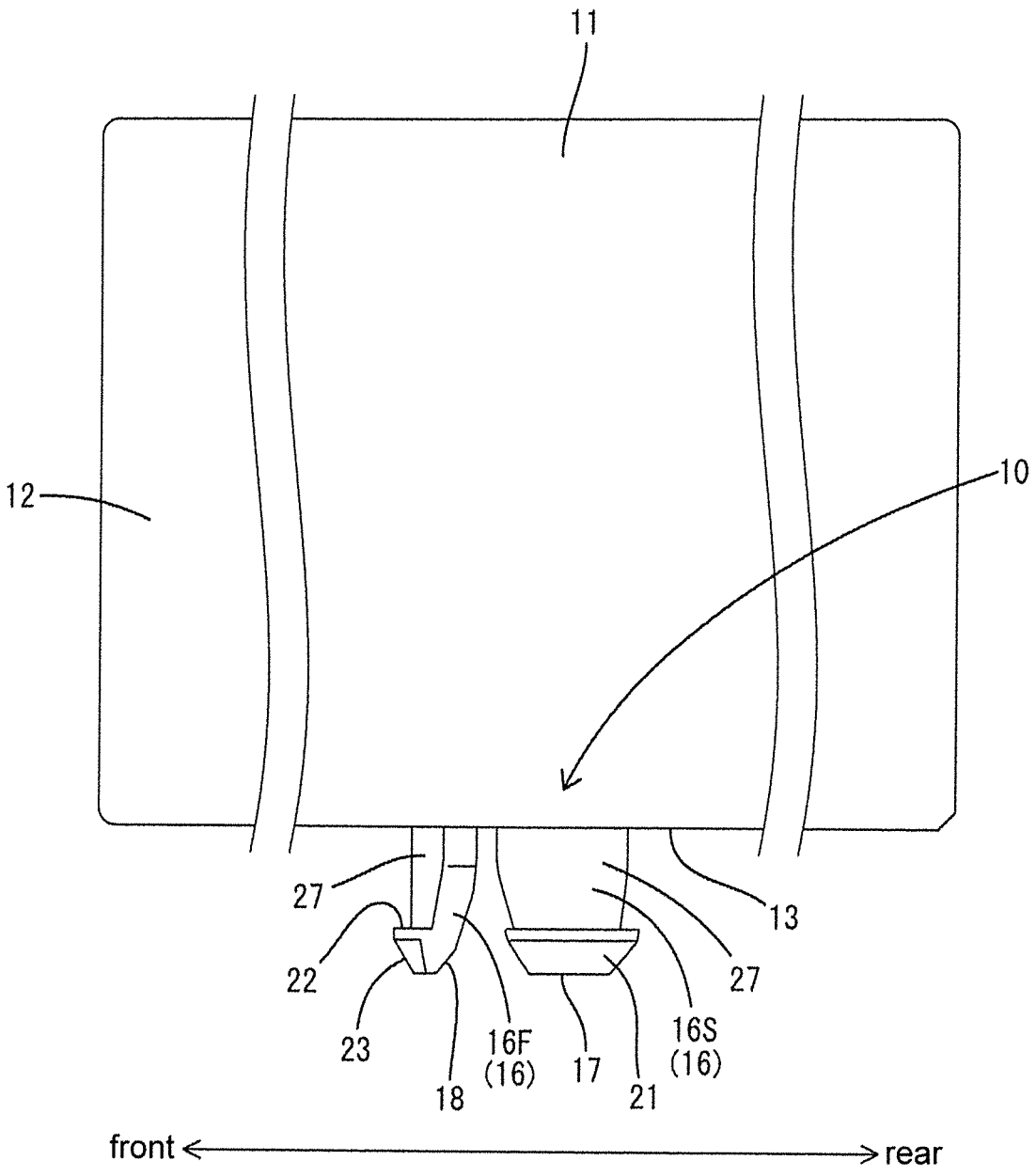
FIG. 2 is a side view of the board connector.

FIGS. 1 to 6 show a first embodiment of a board connector that is to be mounted on a surface of a circuit board 30. The board connector includes a housing 11 that is provided integrally with a fixing portion 10 to be fixed by being inserted into a through hole 31 in the circuit board 30. The through hole 31 has a circular shape and penetrates through the circuit board 30 in a thickness direction. In the following description, a lower side and an upper side in FIG. 1 are referred to as a lower side and an upper side, and a left side and a right side in FIG. 2 are referred to as a front and a rear for each constituent member.

The housing 11 is made of synthetic resin and includes a receptacle 12 to be fit externally to a mating connector 40. The receptacle 12 is a substantially rectangular tube with a rectangular inner peripheral surface and the mating connector 40 can fit therein from the front. Unillustrated terminal fittings are held in the housing 11 and are to be connected electrically to the mating connector 40 and the circuit board 30.

Bulges 14 are provided on a lower surface 13 of the receptacle 12 and bulge slightly down toward the circuit board 30. One of the bulges 14 is provided on each of the left and right sides of the receptacle 12.

Figure 3:
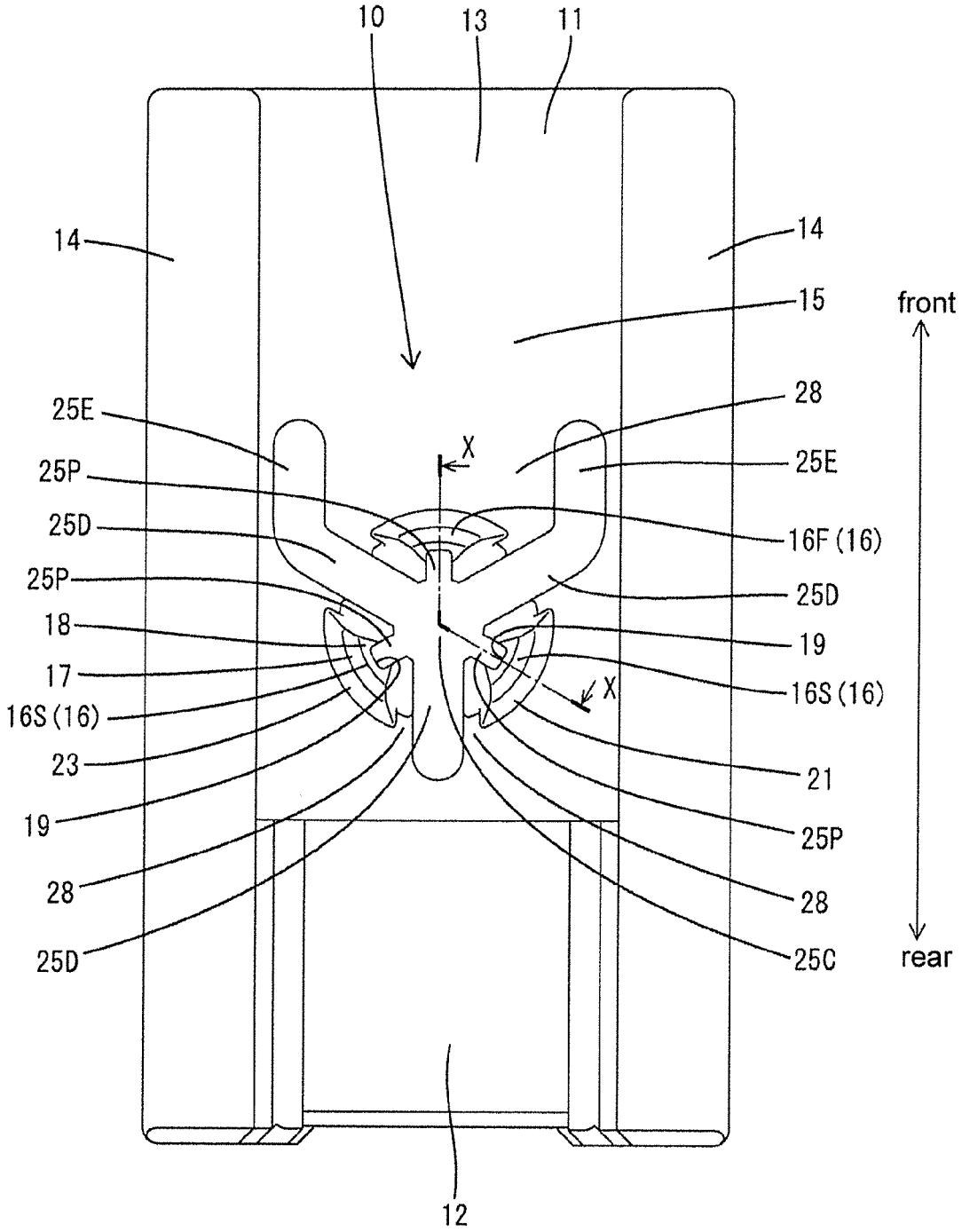
FIG. 3 is a bottom view of the board connector.

As shown in FIG. 3, the bulges 14 are formed entirely over the housing 11 in a front-back direction along both left and right side edges of the receptacle 12 and are bilaterally symmetrical. A part of the lower surface 13 of the receptacle 12 between the left and right bulges 14 defines a stepped recess 15 that is recessed slightly up from the bulges 14. The stepped recess 15 is arranged at a distance from the surface of the circuit board 30.

The fixing portion 10 to be fixed to the circuit board 30 is provided on the lower surface 13 of the receptacle 12 in the stepped recess 15. The fixing portion 10 is provided in a central part of the receptacle 12 in a width direction and the front-back direction of the receptacle 12.

The fixing portion 10 includes three legs 16 standing on the lower surface 13 of the housing 11. Each leg 16 includes a resilient piece 28 located on a base end side (upper end side) and constituting a part of a bottom wall 26 of the receptacle 12 and a main body 27 cantilevered down from the lower surface of the resilient piece 28 (also the lower surface 13 of the bottom wall 26). All of the legs 16 have substantially identically shaped main bodies 27 and are arranged at substantially equal intervals in a circumferential direction. The outer peripheries of the three legs 16 are arranged along a circumference concentric with a center axis 56 (see FIGS. 5(A) and 5(B)) of the fixing portion 10.

Each leg 16 includes a first leg portion 16F in a widthwise central part of the housing 11 and two second leg portions 16S located bilaterally symmetrically behind the first leg portion 16F.

The main body 27 of each leg 16 is in the form of a plate whose thickness in a radial direction of the fixing portion 10 is smaller than a width in the circumferential direction of the fixing portion 10. The outer peripheral surface of the main body 27 is curved to have an arcuate shape matching the shape of the through hole 31 of the circuit board 30.

A lower end surface 17 of the main body 27 is flat and substantially perpendicular to an axial or length direction of the main body 27, as shown in FIG. 1. An inner inclined surface 18 is formed on an inner side of the main body 27 to face the center axis 56 of the fixing portion 10 and is inclined outwardly from top toward the lower end surface 17 (see FIG. 2). The gradient of the inner inclined surface 18 changes at a vertical intermediate position. The inner inclined surface 18 is formed in a range from the lower end surface 17 to a position above a locking surface 22 to be described later.

Figure 4:
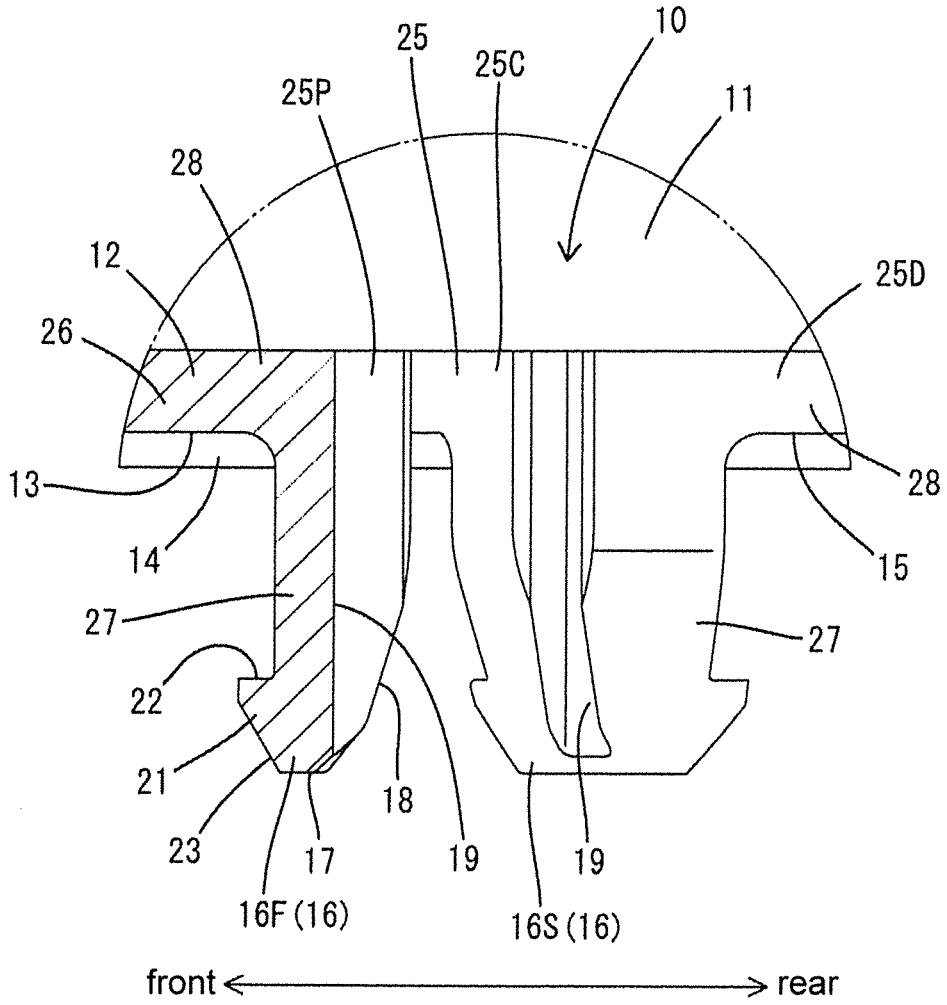
FIG. 4 is a partial enlarged section showing a fixing portion of the board connector.

As shown in FIGS. 3 and 4, a groove 19 is formed on the inner side of the main body 27. The groove 19 is long in the vertical direction and is recessed out and away from the center axis 56 of the fixing portion 10. The groove 19 has a rectangular shape that opens in when viewed from below and is a provided substantially in a widthwise center of each leg 16. The upper end of the groove 19 communicates with a displacement allowing space 25 formed in the bottom wall 26 of the receptacle 12, while the lower end of the groove 19 reaches the vicinity of the lower end surface 17 of the main body 27.

As shown in FIG. 1, a lock 21 is formed at the tip end of the main body 27 and projects radially out on the outer peripheral surface of the main body 27. The lock 21 is provided continuously over the entire circumferential extent of the main body 27 and a projection distance from the outer peripheral surface of the main body 27 is substantially constant on the entire lock 21. The main body 27 including the lock 21 has a fan shape when viewed from below (see FIG. 3).

As shown in FIG. 1, a locking surface 22 is formed the upper surface of each lock 21 and is lockable to the lower surface of the circuit board 30. The locking surface 22 is flat and substantially perpendicular to the axial direction of the main body 27. Each lock 21 has an inclined outer surface 23 whose projection distance gradually increases from the lower end surface 17 of the main body 27 toward an upper side.

The resilient piece 28 of each leg 16 is defined by the displacement allowing space 25 formed in the bottom wall 26 of the receptacle 12. Further, the resilient piece 28 of each leg portion 16 is connected to an adjacent part of the bottom wall 26 without any step except at the displacement allowing space 25 and is resiliently deformable in the vertical direction via the displacement allowing space 25 with the adjacent part (P in FIG. 6) of the bottom wall 26 as a support.

The displacement allowing space 25 is a hole penetrating vertically from the lower surface 13 to the upper surface of the bottom wall 26 of the receptacle 12 and is at a side opposite the side toward which the lock 21 protrudes. As shown in FIG. 3, the displacement allowing space 25 is in the form of a slit when viewed from below and includes a center space 25C arranged on the center axis 56 of the fixing portion 10 and surrounded by the respective main bodies 27. Defining spaces 25D extend radially from the center space 25C and define the resilient pieces 28 adjacent in the circumferential direction. The defining spaces 25D traverse between adjacent resilient pieces 28 and reach outer sides of the legs 16.

Extended spaces 25E are provided on the tips of the defining spaces 25D between the resilient pieces 28 of the first and second legs 16F, 16S. Each extended space 25E extends straight back from an outer end of the defining space 25D. The left and right extended spaces 25E are substantially parallel. Widths of the defining spaces 25D and the extended spaces 25E are substantially constant over the entire lengths.

Penetrating spaces 25P penetrate through the bottom wall 26 of the receptacle 12 at positions between three defining spaces 25D and communicate with the grooves 19 of the respective main bodies 27. The penetrating spaces 25P have the same shape as the groove recesses 19 and define inner end parts of the respective resilient pieces 28 (end parts on the side of the center axis 56 of the fixing portion 10) together with the center space 25C.

The leg portion 16F located on the front is provided with a pressed portion 24 projecting from the upper surface of the resilient piece 28 (inner surface of the bottom wall 26 of the receptacle 12). The upper surface of the pressed portion 24 is inclined moderately up toward the center space 25C and the upper end thereof reaches an opening edge of the center space 25C. In the process of connecting the housing 11 to the mating connector 40, the upper surface of the pressed portion 24 slides on the lower surface of the mating connector 40 to apply an oblique downward pressing force (F in FIGS. 5(A) and 5(B)) to the leg portion 16F and the lock 21 is displaced out and away from the center axis 56 of the fixing portion 10).

Next, an example of an operation of fixing the board connector of the first embodiment to the circuit board 30 is described.

When the fixing portion 10 is inserted into the through hole 31 of the circuit board 30, the outer inclined surfaces 23 of the locks 21 of the respective legs 16 contact peripheral edges of the through hole 31. Thus, the resilient pieces 28 of the respective legs 16 displace gradually up and the tips of the respective main bodies 27 are displaced in toward each other. The resilient pieces 28 on the base end sides (upper end sides) face the displacement allowing spaces 25. Therefore, the respective legs 16 are displaced easily via the displacement allowing space 25.

Figure 6:
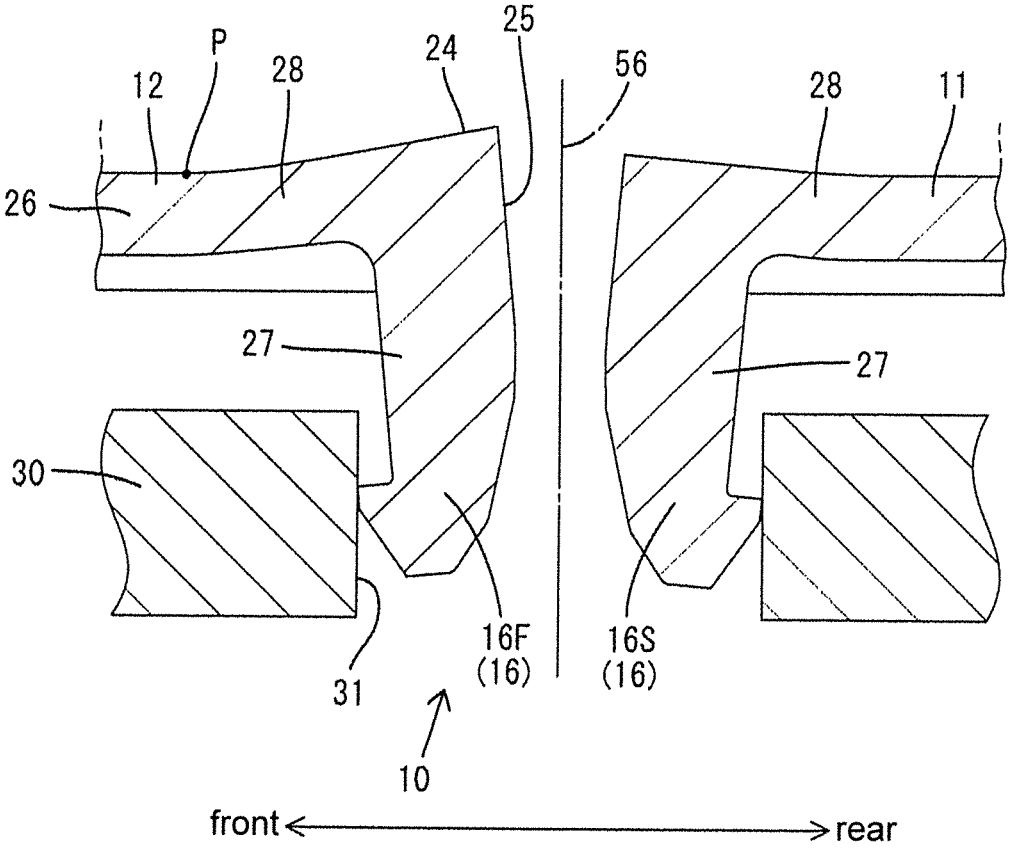
FIG. 6 is a cross-section along X-X of FIG. 3 showing a state in the process of inserting the fixing portion of the circuit board into the through hole of the circuit board.

The inward displacement of the main bodies 27 enable the locks 21 to be inserted into the through hole 31 (see FIG. 6). However, the resilient pieces 28 resiliently restore when the locks 21 pass over the through hole 31. Then, the locking surfaces 22 of the locks 21 of the respective legs 16 are locked to the lower surface (underside) of the circuit board 30 and the board connector is fixed to the circuit board 30. In the above way, the operation of fixing the board connector to the circuit board 30 is completed.

Figure 5A:
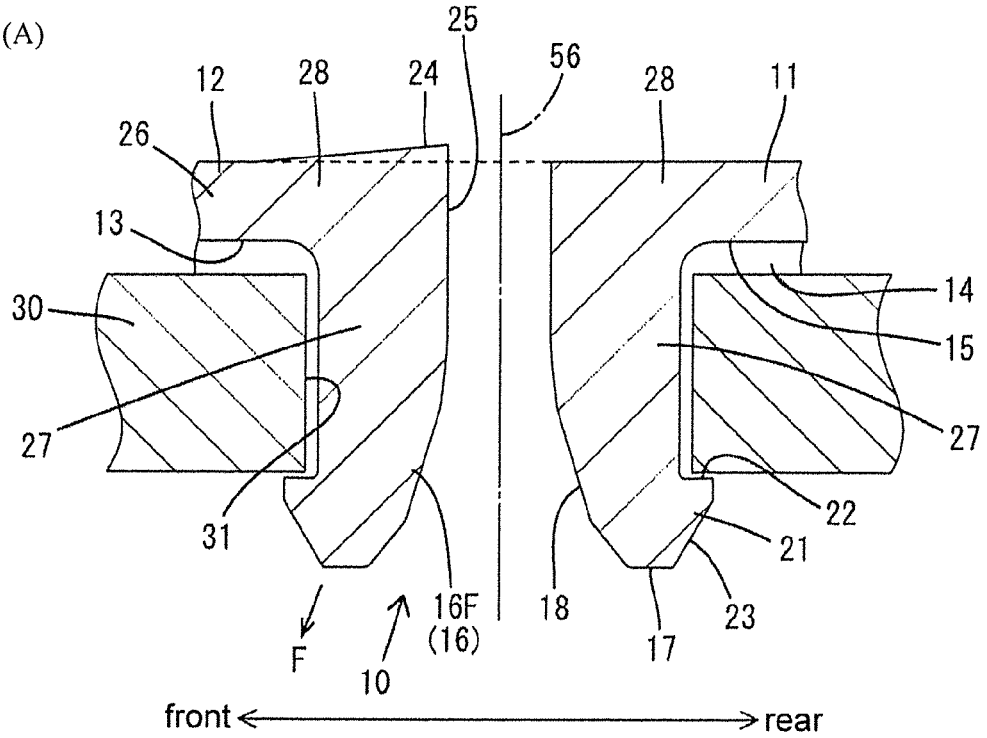
FIG. 5(A) is a cross-section along X-X of FIG. 3 showing the fixing portion of the board connector inserted in a through hole of the circuit board and FIG. 5(B) is a cross-section along X-X of FIG. 3 showing a state where a pressed portion is pressed by a mating connector.
Figure 5B:
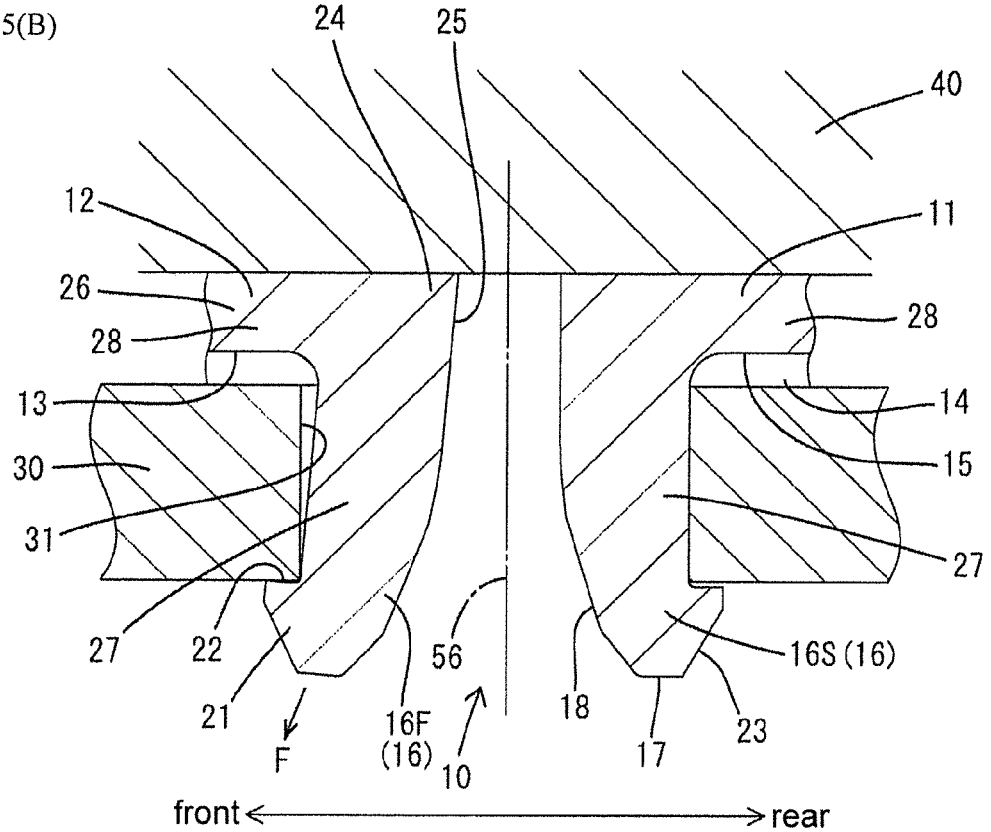

When the mating connector 40 is connected to the board connector fixed to the circuit board 30, the pressed portion 24 is pressed down by a housing of the mating connector 40 fit into the receptacle 12, as shown in FIG. 5(B). Associated with that, the leg 16F is inclined and the lock 21 is displaced out to increase a locking margin with the lower surface of the circuit board 30. In this way, the locking portion 21 and the circuit board 30 are more deeply locked.

Next, functions and effects of the first embodiment configured as described are described.

In the board connector of the first embodiment, the lock 21 is provided on the tip (lower end side in the first embodiment) of the leg 16 and protrudes in the direction intersecting the projecting direction of the main body 27 from the lower surface 13 of the receptacle 12 for being locked to the lower surface of the circuit board 30. Additionally, the base (upper end in the first embodiment) of the leg 16 is defined by the allowing space 25 recessed inwardly (within the thickness of the bottom wall 26 of the receptacle in the first embodiment) from the lower surface 13 of the receptacle 12 to allow a resilient displacement of the leg 16.

According to this configuration, the base end of the leg 16 extends up to the bottom wall 26 of the receptacle 12 as the resilient piece 28 defined by the displacement allowing space 25 and a resilient displacement region (movable region) of the leg 16 is ensured over the entire length of the leg 16 including the bottom wall 26. Thus, the leg 16 can be displaced easily and smoothly without enlarging of the board connector in the vertical direction since the resilient piece 28 is provided in the bottom wall 26.

Further, the displacement allowing space 25 is a hole penetrating through the bottom wall 26 of the receptacle 12 in the vertical or thickness direction, thereby ensuring a sufficiently long resilient displacement region of the leg 16. Furthermore, the pressed portion 24 to be pressed by the mating connector 40 fit into the receptacle 12 is provided on an opening edge part of the displacement allowing space 25 on the upper surface of the bottom wall 26 of the receptacle 12. Thus, the pressed portion 24 is pressed by the mating connector 40, and the lock 21 can be displaced in a direction to increase the locking margin with the circuit board 30 and a locking force of the leg 16 to the circuit board 30 can be enhanced.

Next, a board connector according to a second specific embodiment of the present invention is described with reference to FIG. 7.

The board connector of the second embodiment differs from the first embodiment by including an inserting member 50 to be inserted at an inner side of three legs 16. The same components as in the first embodiment are denoted by the same reference signs and not repeatedly described.

The board connector of the second embodiment includes three legs 16 arranged via a displacement allowing space 25 as in the first embodiment. Each leg 16 includes a main body 27 cantilevered from a lower surface 13 of a receptacle 12 and a lock 21 projecting laterally from a tip part of the main body 27. The displacement allowing space 25 defines a resilient piece 28 at a base end of the leg 16.

The inserting member 50 is inserted into a central part of a fixing portion 10 from below after the board connector is fixed to a circuit board 30. The inserting member 50 is made of synthetic resin and formed separately from a housing 11. The inserting member 50 includes a shaft 51 to be inserted between the main bodies 27 of the three legs 16 of the fixing portion 10 and a jaw 52 projecting out on one end of the shaft 51. The shaft 51 is a column with a cross-sectional shape for contacting inner side surfaces of the main bodies 27 of all of the legs 16 with the inserting member 50 inserted in the central part of the fixing portion 10. The jaw 52 projects over the entire circumference while having a fixed dimension with the shaft 51 as a center.

The lower surface (surface opposite to the shaft 51) of the jaw 52 serves as a pressing surface 53 to be pressed when the inserting member 50 is inserted into the fixing portion 10. The pressing surface 53 is substantially perpendicular to a center axis 56 of the shaft 51.

A tapered portion 54 is provided on the upper surface of the jaw 52 and a lower part of the shaft 51 and is inclined up from an outer side toward the center axis 56.

A contact surface 55 is formed at an outer periphery of the tapered portion 54 on the upper surface of the jaw 52. The contact surface 55 butts against lower end surfaces 17 of the legs 16 when the inserting member 50 is inserted into the fixing portion 10. The contact surface 55 is a surface substantially perpendicular to the center axis 56 of the shaft 51 and substantially parallel to the pressing surface 53.

Figure 7A:
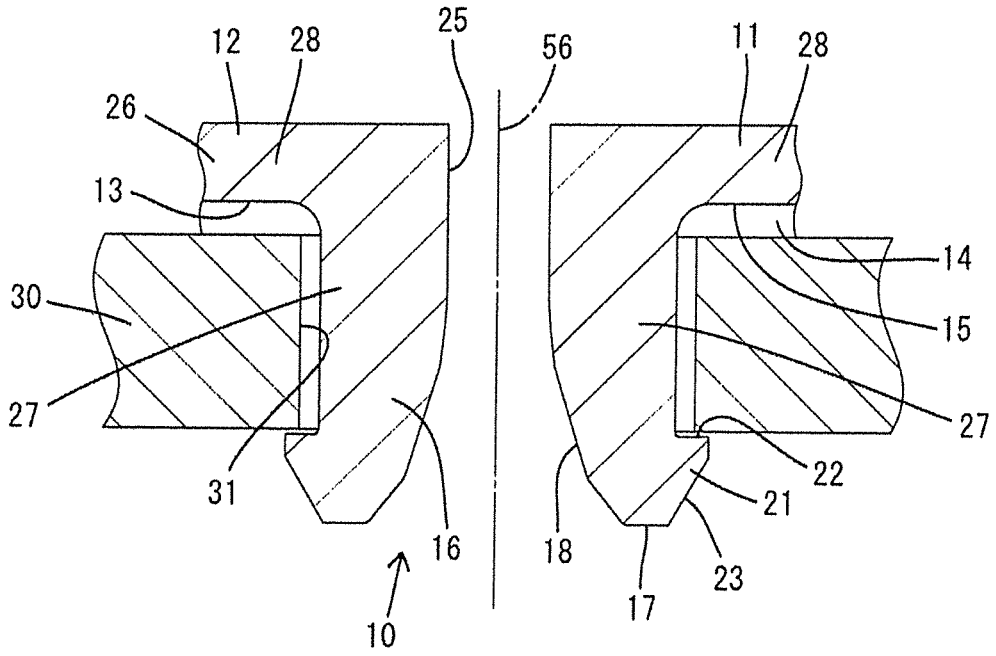
Figure 7B:
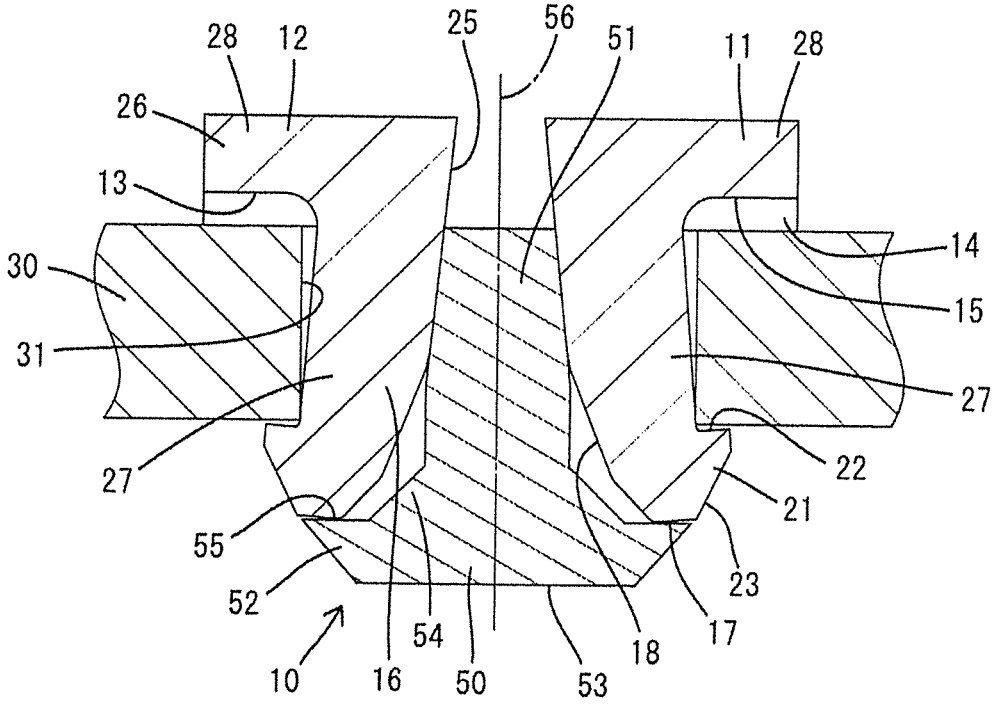

The inserting member 50 is inserted into the central part of the fixing portion 10, as shown in FIG. 7(B), after the board connector is fixed to the circuit board 30 as shown in FIG. 7(A). When the shaft 51 is inserted into a center of the fixing portion 10 and the pressing surface 53 is pressed, the shaft 51 contacts inclined inner surfaces 18 of the legs 16 to be guided to a central side and pushed between the three legs 16. All of the legs 16 are pressed out (toward such sides that the circuit board 30 and the locks 21 are locked more deeply) by the shaft 51 of the inserting member 50 and the locks 21 are displaced in directions to increase locking margins with the circuit board 30. Further, the contact surface 55 of the inserting member 50 contacts the lower end surfaces 17 of the main bodies 27 of the legs 16, thereby restricting any further pushing. In this way, the inserting member 50 is inserted into the fixing portion 10.

As described above, in the second embodiment, the inserting member 50 is inserted between the legs 16 to restrict a displacement of each leg 16. Thus, a state where the locks 21 are locked to the circuit board 30 can be maintained stably.

The invention is not limited to the above described and illustrated embodiments. For example, the following embodiments also are included in the scope of the invention.

Although the fixing portion 10 includes three legs 16 in the first and second embodiments, there is no limitation to this and only one, two, four or more leg portions may be provided.

Although the displacement allowing space 25 penetrates through the bottom wall 26 of the receptacle 12 in the vertical direction in the first and second embodiments, there is no limitation to this. For example, the displacement allowing space may be a bottomed recess formed by recessing the lower surface of the housing and having a closed upper side.

Although the shape of the displacement allowing space 25 is illustrated in the above first and second embodiments, there is no limitation to this and the displacement allowing space portion may include only the center space.

Although the leg 16 includes the pressed portion 24 in the first embodiment, it is not always necessary to provide the pressed portion.

Although none of the legs has the pressed portion 24 in the second embodiment, there is no limitation to this and the inserting member may have the pressed portion is provided on the leg.

The legs may be provided not on the bottom wall of the receptacle, but on the bottom surface of a part in the form of a vertical wall or a block.

The receptacle may be open upward and the mating connector may be fitted thereinto from above. In this case, the pressed portion is pushed down by the mating connector entering from above in the above first embodiment. Thus, the upper surface of the pressed portion need not be an inclined surface and may be a horizontal surface.

The main body of the leg may be formed to be resiliently deformed.

LIST OF REFERENCE SIGNS

11 . . . housing
12 . . . receptacle
13 . . . lower surface (wall surface facing circuit board)
16 . . . leg
21 . . . lock
24 . . . pressed portion
25 . . . displacement allowing space
26 . . . bottom portion (wall portion facing circuit board)
30 . . . circuit board
40 . . . mating connector
50 . . . inserting member

What is claimed is:

1. A board connector, comprising:

a housing having a bottom wall with a bottom surface facing a surface of a circuit board and a top surface opposite the bottom surface, a center space formed through the bottom wall from the bottom surface to the top surface, first and second defining slots formed through the bottom wall from the bottom surface to the top surface and extending away from the center space so that a resilient piece is defined by the bottom wall between the defining slots;

a leg provided on the resilient piece and projecting on the bottom surface at a position adjacent the center space; and a lock provided on an end of the leg remote from the bottom surface and protruding in a direction intersecting a projecting direction of the leg from the bottom surface so that a top surface of the lock is opposed to the resilient piece and can be resiliently locked to an underside of the circuit board.

2. The board connector of claim 1, wherein the housing includes a tubular receptacle, the top surface of the bottom wall of the housing facing into the receptacle.

3. The board connector of claim 2, wherein a pressed portion is provided on the top surface of a part of the bottom wall defining the resilient piece and at an opening edge part of the center space, the pressed portion being pressed by a mating connector fit into the receptacle, thereby deflecting the resilient piece down and deflecting the leg and the lock into more secure engagement with the circuit board.

4. The board connector of claim 1, wherein the resilient piece is a first resilient piece, a third defining slot being formed through the bottom wall from the bottom surface to the top surface and extending away from the center space so that a second resilient piece is defined between the first slot and the third slot and a third resilient piece is defined between the second slot and the third slot, the legs projecting from the first resilient piece being a first leg and the lock provided on the first leg being a first lock, second and third legs projecting from the second and third resilient pieces respectively and second and third locks being formed respectively on the second and third legs, the legs being arranged around the center space and an inserting member being inserted between the legs.

5. The board connector of claim 1, wherein the housing is formed from a synthetic resin and the leg and the lock are integral with the housing.

6. The board connector of claim 1, wherein the leg is substantially perpendicular to the bottom wall of the housing.

7. A board connector to be connected to a circuit board, the board connector comprising:

a housing having a bottom wall with opposite bottom surface facing a surface of the circuit board and a top surface opposite the bottom surface;

a center hole penetrating through the bottom wall from the bottom surface to the top surface;

defining slots formed through the bottom wall from the bottom surface to the top surface and extending radially out from the center hole so that resilient pieces are formed by the bottom wall between the defining slots legs formed respectively on the resilient pieces and projecting down from a part of each resilient piece adjacent the center hole; and locks formed respectively on the legs and projecting radially out from an end of the respective leg remote from the resilient piece so that a top surface of each lock faces the respective resilient piece, wherein the legs are displaced toward one another when the board connector is mounted to the circuit board and resiliently return so that the locks engage an underside of the circuit board.

8. The board connector of claim 7, wherein the housing includes a tubular receptacle, the top surface of the bottom wall of the housing facing into the receptacle.

9. The board connector of claim 8, further comprising an inclined pressed portion projecting from the top surface of the bottom wall at a part of at least one of the resilient pieces adjacent the center hole.

10. The board connector of claim 7, further comprising an inserting member inserted between the legs from below.

11. The board connector of claim 7, wherein the housing is formed from a synthetic resin and the leg and the lock are integral with the housing.

12. The board connector of claim 7, wherein the legs are substantially perpendicular to the bottom wall of the housing.

* * * * *